US012714220B2

(12) United States Patent
Xu et al.

(10) Patent No.: US 12,714,220 B2
(45) Date of Patent: Aug. 25, 2026

(54) TOOTHBRUSH

(71) Applicant: SHANGHAI SHIFT ELECTRICS CO., LTD., Shanghai (CN)

(72) Inventors: Zhenwu Xu, Shanghai (CN); Xiaoguo Dai, Shanghai (CN); Changjin Zhang, Shanghai (CN); Hongtao Zhang, Shanghai (CN)

(73) Assignee: SHANGHAI SHIFT ELECTRICS CO., LTD., Shanghai (CN)

( * ) Notice: Subject to any disclaimer, the term of this patent is extended or adjusted under 35 U.S.C. 154(b) by 557 days.

(21) Appl. No.: 18/253,211

(22) PCT Filed: May 10, 2021

(86) PCT No.: PCT/CN2021/092779
§ 371 (c)(1),
(2) Date: May 17, 2023

(87) PCT Pub. No.: WO2022/105148
PCT Pub. Date: May 27, 2022

(65) Prior Publication Data

US 2023/0404249 A1 Dec. 21, 2023

(30) Foreign Application Priority Data

Nov. 18, 2020 (CN) ..... 202011296169.8

(51) Int. Cl.
*A46B 5/00* (2006.01)
*A46B 9/04* (2006.01)

(52) U.S. Cl.
CPC ..... *A46B 5/0083* (2013.01); *A46B 5/0058* (2013.01); *A46B 9/04* (2013.01); *A46B 2200/1066* (2013.01)

(58) Field of Classification Search
CPC ..... A46B 5/0095; A46B 9/04; A46B 5/0058; A46B 5/0083; A46B 5/0038; A61C 17/222
(Continued)

(56) References Cited

U.S. PATENT DOCUMENTS

2015/0289959 A1 10/2015 Bronikowski
2023/0404727 A1* 12/2023 Xu ..... A46B 5/007

FOREIGN PATENT DOCUMENTS

CN 101797092 A 8/2010
CN 205322533 U 6/2016
(Continued)

OTHER PUBLICATIONS

International Search Report of PCT/CN2021/092779.

*Primary Examiner* — Laura C Guidotti
(74) *Attorney, Agent, or Firm* — Kilpatrick Townsend & Stockton LLP

(57) ABSTRACT

A toothbrush, including a head, a handle, and a first rotating structure, and the head has a rotation axis (C1) extending in a length direction; the first rotating structure includes a rotating member connected to the head and a connecting member connected to the handle, the surface of the connecting member facing the head (20) is provided with an insertion groove extending along the rotation axis (C1), and the end of the rotating member facing away from the head is inserted into the insertion groove and is rotatably connected to the connecting member; the rotating member is provided with a first snap-fit member, and the connecting member is provided with a second snap-fit member; and when there are first snap-fit members and/or second snap-fit members, any one of the first snap-fit members can pass over each second snap-fit member in sequence while rotating along with the rotating member.

9 Claims, 7 Drawing Sheets

(58) Field of Classification Search
USPC ..... 15/176.1, 176.6
See application file for complete search history.

(56) References Cited

FOREIGN PATENT DOCUMENTS

| | | | | | |
|---|---|---|---|---|---|
| CN | 110679501 | A | | 1/2020 | |
| CN | 111184587 | A | | 5/2020 | |
| CN | 211094912 | U | | 7/2020 | |
| CN | 211300447 | U | | 8/2020 | |
| CN | 112369793 | A | | 2/2021 | |
| JP | 2017-205438 | A | * | 11/2017 | ..... A61C 17/34 |
| KR | 200439379 | Y1 | * | 4/2008 | ..... A46B 7/06 |
| WO | WO 2022105144 | A1 | * | 5/2022 | ..... A46B 9/04 |

* cited by examiner

C-C

D-D

TOOTHBRUSH

The present application claims priority to Chinese Patent Application No. 202011296169.8, filed with the China National Intellectual Property Administration on Nov. 18, 2020 and entitled "TOOTHBRUSH", which is incorporated herein by reference in its entirety.

TECHNICAL FIELD

The present application relates to the field of oral cleaning, and more particularly to a toothbrush.

BACKGROUND ART

Existing toothbrushes are mostly of an integral fixed structure, and angles of the toothbrushes can only be adjusted by the wrist during brushing, which brings inconvenience to a brushing operation.

SUMMARY OF THE DISCLOSURE

Embodiments of the present application are to improve the convenience of a brushing operation.

In order to solve the above technical problem, a technical solution used in the embodiments of the present application is as follows:

a toothbrush, including a head, a handle, and a first rotating structure, and the head has a rotation axis extending in a length direction; the first rotating structure includes a rotating member connected to the head and a connecting member connected to the handle, the surface of the connecting member facing the head is provided with an insertion groove extending along the rotation axis, and the end of the rotating member facing away from the head is inserted into the insertion groove and is rotatably connected to the connecting member; the rotating member is provided with a first snap-fit member, and the connecting member is provided with a second snap-fit member; and when there are second snap-fit members, the first snap-fit member is capable of passing over each second snap-fit member in sequence while rotating along with the rotating member, and is snap-fitted with any one of the second snap-fit members to limit the rotation of the rotating member when opposite the second snap-fit member;

or when there are first snap-fit members, the first snap-fit members are capable of passing over the second snap-fit member in sequence while rotating along with the rotating member, and any one of the first snap-fit members is snap-fitted with the second snap-fit member to limit the rotation of the rotating member when opposite the second snap-fit member.

The toothbrush provided by the present application enables the rotational connection of the head and the handle about the rotation axis by providing the first rotating structure, and the head and the handle are relatively fixed at a specific angle by providing a projection and a snap groove. During brushing, a user rotates the head relative to the handle at a desired angle according to actual requirements to facilitate a brushing operation.

BRIEF DESCRIPTION OF THE DRAWINGS

To describe the technical solutions in the embodiments of the present application more clearly, the following briefly describes the accompanying drawings required for illustrating the embodiments or exemplary technical description. The accompanying drawings in the following description show some embodiments of the present application.

DETAILED DESCRIPTION OF EMBODIMENTS

Embodiments of the present application are further described in detail below with reference to the accompanying drawings and embodiments. It should be understood that the embodiments described here are only used to explain, rather than limiting, the present application.

Referring to FIGS. 1 to 16, a toothbrush provided by the present disclosure is described in accordance with embodiments.

The toothbrush includes a head 20, a handle 10, and a first rotating structure 30. The head 20 has a rotation axis C1 extending in a length direction. When the toothbrush is placed upright, the head 20 and the handle 10 are arranged one above the other, with the rotation axis C1 as a vertical extending direction.

The head 20 is connected rotatably about the rotation axis C1 to the handle 10 via the first rotating structure 30.

Figure 2:
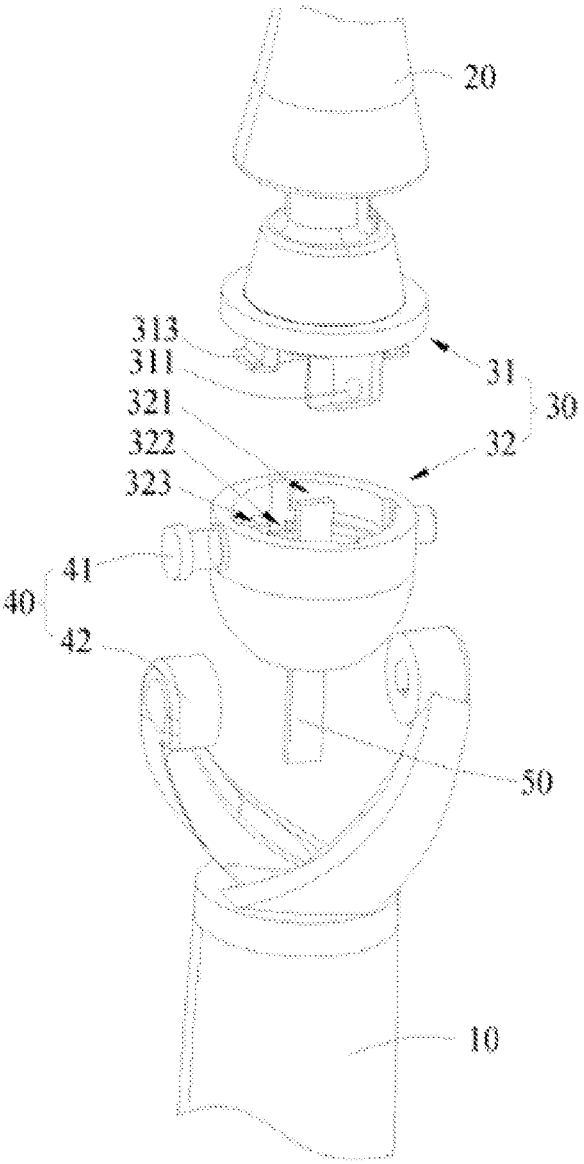
FIG. 2 is a schematic exploded view of the structure in FIG. 1.
Figure 3:
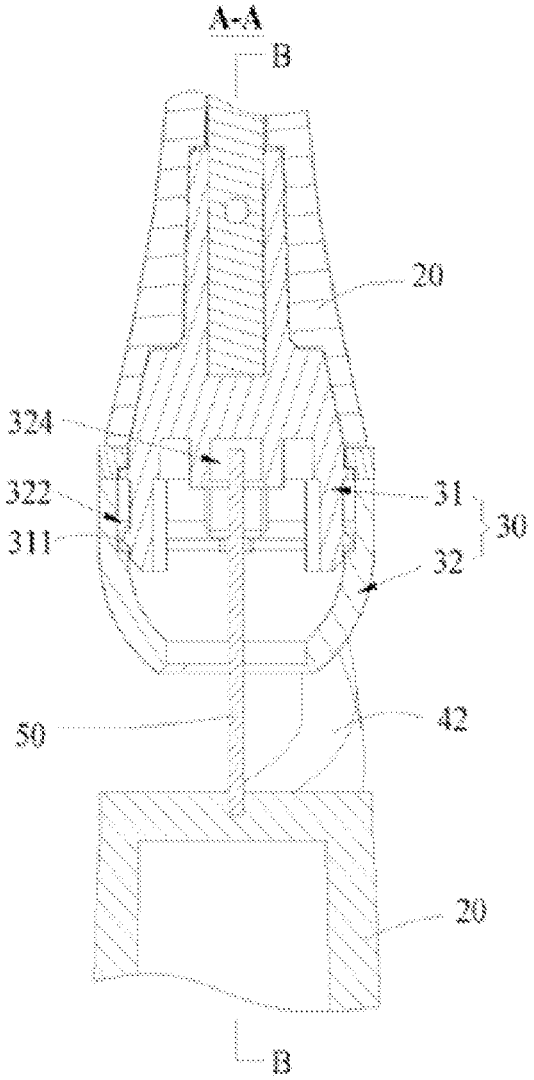
FIG. 3 is a sectional view taken along line A-A of the structure in FIG. 1.
Figure 4:
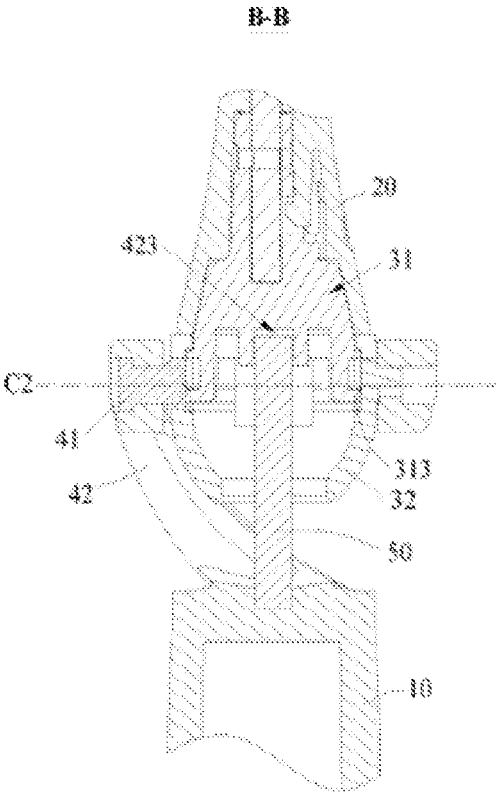
FIG. 4 is a sectional view taken along line B-B of the structure in FIG. 3.
Figure 6:
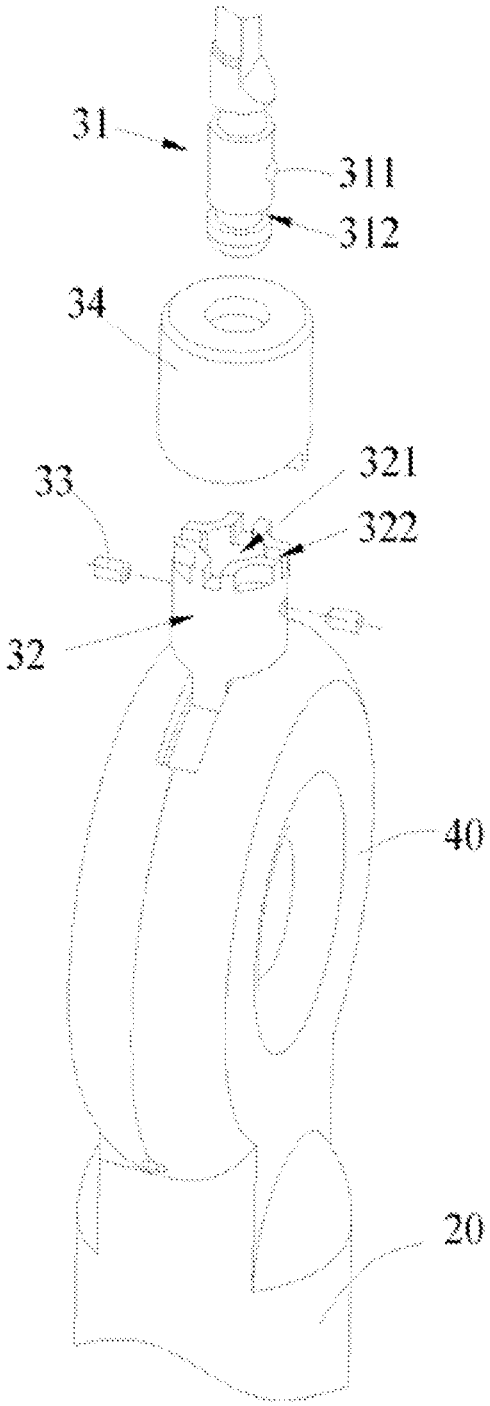
FIG. 6 is a partial schematic exploded view I of the structure in FIG. 5.
Figure 7:
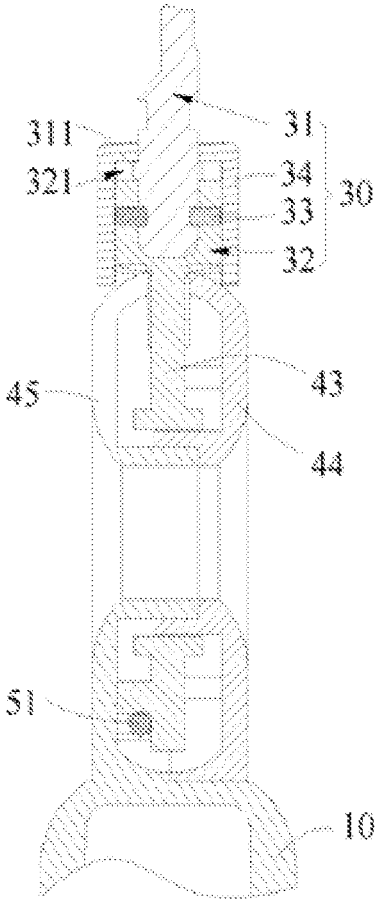
FIG. 7 is a sectional view of the structure in FIG. 6.

In one embodiment, referring to FIGS. 2 to 4, or to FIGS. 6 and 7, the first rotating structure 30 includes a rotating member 31 connected to the head 20 and a connecting member 32 connected to the handle 10, the surface of the connecting member 32 facing the head 20 is provided with an insertion groove 321 extending along the rotation axis C1, and the end of the rotating member 31 facing away from the head 20 is inserted into the insertion groove 321 and rotatably connected to the connecting member 32.

The rotating member 31 is provided with a first snap-fit member 311, and the connecting member 32 is provided with a second snap-fit member 322. When there are first snap-fit members 311 or second snap-fit members 322, any one of the first snap-fit members 311 can be snap-fitted with any one of the second snap-fit members 322 when opposite the second snap-fit member 322.

When there are second snap-fit members 322, the first snap-fit member 311 can pass over each second snap-fit member 322 in sequence while rotating along with the rotating member 31, and is snap-fitted with any one of the second snap-fit members 322 to limit the rotation of the rotating member 31 when opposite the second snap-fit member 322.

In one embodiment, when there are first snap-fit members 311, the first snap-fit members 311 can pass over the second snap-fit member 322 in sequence while rotating along with the rotating member 31, and any one of the first snap-fit members 311 is snap-fitted with the second snap-fit member 322 to limit the rotation of the rotating member 31 when opposite the second snap-fit member 322.

The insertion groove 321 limits a radial movement of the rotating member 31. The rotating member 31 has a rotational degree of freedom about the rotation axis C1 in the insertion groove 321.

The fitted configuration of the first snap-fit member 311 and the second snap-fit member 322 limits the rotation of the rotating member 31 about the rotation axis C1 when the first snap-fit member 311 is opposite the second snap-fit member 322 and is snap-fitted with the second snap-fit member 322, so that the rotating member 31 and the connecting member 32 are in a relatively fixed state. When an external force for driving the rotating member 31 to rotate is greater than a resistance to a relative movement of the first snap-fit member 311 and the second snap-fit member 322, the first snap-fit member 311 is separated from the second snap-fit member 322 to allow the rotation of the rotating member 31.

In another embodiment of the present utility model, the first snap-fit member 311 is a protrusion that is provided on the surface of the rotating member 31 abutting against the insertion groove 321, and the second snap-fit member 322 is a snap groove that is formed in the connecting member 32 and that is in communication with the insertion groove 321; or the first snap-fit block is a snap groove that is formed in the rotating member 31 and that is in communication with the insertion groove 321, and the second snap-fit member 322 is a protrusion that is provided on the surface of the connecting member 32 abutting against the insertion groove 321.

The first snap-fit member 311 and the second snap-fit member 322 use the configuration in which the protrusion is fitted with the snap groove, facilitating the simplification of the structure. When the protrusion is received in the snap groove, the relative rotation of the rotating member 31 and the connecting member 32 about the rotation axis C1 is achieved. When the protrusion is separated from the snap groove, the relative rotation of the rotating member 31 and the connecting member 32 about the rotation axis C1 is allowed.

The position where the first snap-fit member 311 is snap-fitted to the second snap-fit member 322 determines the relatively fixed position of the head 20 and the handle 10.

When there is one first snap-fit member 311 and four second snap-fit members 322, there are four relatively fixed positions between the head 20 and the handle 10. Further, when the four second snap-fit members 322 are arranged about the rotation axis C1 at equal intervals, the positions of two adjacent second snap-fit members 322 differ by 90° relative to each other, that is, the head 20 is forwardly or reversely rotated by 90° from a first relatively fixed position to another adjacent relatively fixed position.

When there is one first snap-fit member 311 which is a protrusion, and six second snap-fit members 322 which are snap grooves, a rotation path of the protrusion along with the rotating member 31 is circular about the rotation axis C1, and the snap grooves are distributed on the rotation path. A first snap groove is located at an initial position, a second snap groove to a sixth snap groove are arranged in positions of $\pi/12$, $\pi/6$, $\pi/3$, $\pi/2$ and $\pi$ of the rotation path in sequence, and correspondingly, the head 20 is rotated by 15°, 30°, 60°, 90° and 180° from the position of the first snap groove to sequentially reach the second snap groove, a third snap groove, a fourth snap groove, a fifth snap groove and the sixth snap groove. A person skilled in the art would have been able to set the number of snap grooves to two, three, four, five, six, seven, eight, etc. according to actual requirements, and set a spacing between adjacent snap grooves according to requirements, which is not uniquely limited herein.

Similarly, when there is one first snap-fit member 311 which is a snap groove, and six second snap-fit members 322 which are projections, a rotation path of the snap groove along with the rotating member 31 is circular about the rotation axis C1, and the projections are distributed on the rotation path. A first projection is located at an initial position, and a second projection to a sixth projection are arranged in positions of $\pi/12$, $\pi/6$, $\pi/3$, $\pi/2$ and $\pi$ of the rotation path in sequence, and correspondingly, the head 20 is rotated by 15°, 30°, 60°, 90° and 180° from the position of the first projection to sequentially reach the second projection, a third projection, a fourth projection, a fifth projection and the six projection.

It should be noted that the first snap-fit member 311 and the second snap-fit member 322 may be in a one-to-multiple, multiple-to-one, or multiple-to-multiple relationship. For example, the number of first snap-fit members 311 is two, and the number of second snap-fit members 322 is four; or the number of first snap-fit members 311 and the number of second snap-fit members 322 are both four. It is only required that any one of the first snap-fit members 311 can be snap-fitted with any one of the second snap-fit members 322 in sequence while rotating along with the rotating member 31.

It can be appreciated that the projection has an inclined guide surface to reduce the difficulty of separating the snap groove from the projection. A groove wall of the snap groove and a groove wall of the insertion groove 321 are chamfered for transition. This configuration can further reduce the difficulty of separating the projection from the snap groove.

The toothbrush provided in this embodiment enables the rotational connection of the head 20 and the handle 10 about the rotation axis C1 by providing the first rotating structure 30, and the head 20 and the handle 10 are relatively fixed at a specific angle by means of the fitted configuration of the first snap-fit members 311 and the second snap-fit members 322. During brushing, a user rotates the head relative to the handle 10 at a desired angle according to actual requirements to facilitate a brushing operation.

Embodiment I

Referring to FIGS. 2 and 4, in this embodiment, the first snap-fit member 311 is a protrusion that is provided on the surface of the rotating member 31 abutting against the insertion groove 321, and the second snap-fit member 322 is a snap groove that is formed in the connecting member 32 and that is in communication with the insertion groove 321.

The connecting member 32 is provided with an annular first groove 323 in the groove wall of the insertion groove 321, and the rotating member 31 is provided with an elastic snap block 313 fitted with the first groove 323. When the rotating member 31 rotates about the rotation axis C1, the elastic snap block 313 rotates along the first groove 323 and limits axial movements of the rotating member 31 and the connecting member 32.

During assembly, the rotating member 31 is inserted into the insertion groove 321 from the top, and in this process, the groove wall of the insertion groove 321 abuts against the elastic snap block 313, causing the elastic snap block to be elastically deformed. When the elastic snap block reaches the first groove 323, a pressure from the groove wall of the insertion groove 321 disappears, and the elastic snap block 313 is restored under an elastic restoring force to snap into the first groove 323. The first groove 323 is annular to prevent the elastic snap block 313 located in the first groove 323 from limiting the rotation of the rotating member 31.

In another embodiment of the present utility model, referring to FIG. 2, each snap groove (second snap-fit member 322) extends along the rotation axis C1 to the surface of the connecting member 32 facing the rotating member 31. This configuration can facilitate the assembly of the rotating member 31. In one embodiment, since the snap groove extends to an upper surface of the connecting member 32, when the rotating member 31 is inserted into the insertion groove 321 from the top, the projection (first snap-fit member 311) can go downward along the snap groove until a design height is reached. In other words, an upward extending portion of the snap groove can achieve the effect of avoiding the downward assembly of the projection.

It should be noted that the snap groove in this embodiment is only required to limit the movement of the projection in a circumferential direction, so that upward extending the snap groove to the upper surface of the connecting member 32 does not affect the functional requirements of the snap groove.

Embodiment II

This embodiment differs from Embodiment I in that limiting structures of the connecting member 32 and the rotating member 31 in an axial direction are different.

Referring to FIGS. 6 and 7, in the toothbrush provided in this embodiment, an outer surface of the rotating member 31 is provided with an annular second groove 312, and an outer surface of the connecting member 32 is provided with an insertion hole in communication with the insertion groove 321.

The first rotating structure 30 includes a connecting pin 33 arranged in the insertion hole and extending into the second groove 312.

The connecting pin 33 limits the axial movements of the connecting member 32 and the rotating member 31, so that the degree of freedom of the rotating member 31 in the axial direction is limited, and in combination with the configuration of the insertion groove 321, the rotating member 31 has only a rotational degree of freedom about the rotation axis C1. The second groove 312 is arranged in an annular shape to prevent the connecting pin 33 penetrating into the second groove 312 from limiting the rotation of the rotating member 31.

During assembly, the rotating member 31 is inserted into the insertion groove 321, and the connecting pin 33 is then inserted into the insertion hole and extends into the second groove 312. It can be seen from the above that the fitting of the insertion hole and the connecting pin 33 can facilitate the operation.

In another embodiment of the present utility model, referring to FIGS. 6 and 7, the first rotating structure 30 further includes a protective sleeve 34 provide at an outside of the connecting member 32, and the protective sleeve 34 restricts the connecting pin 33 from leaving the insertion hole. In the illustrated structure, the protective sleeve 34 is annular and can be downward sleeved on the connecting member 32 from the top of the rotating member 31. The protective sleeve 34 encloses the position where the rotating member 31 is connected to the connecting member 32, to facilitate the provision of an aesthetic effect of the toothbrush.

Embodiment III

Figure 11:
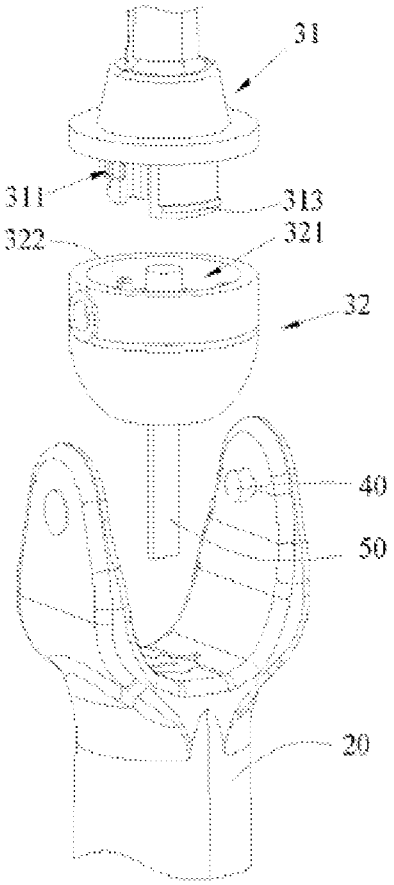
FIG. 11 is a schematic view III of the toothbrush according to the embodiment of the present application, which is a schematic exploded view of a partial structure.
Figure 12:
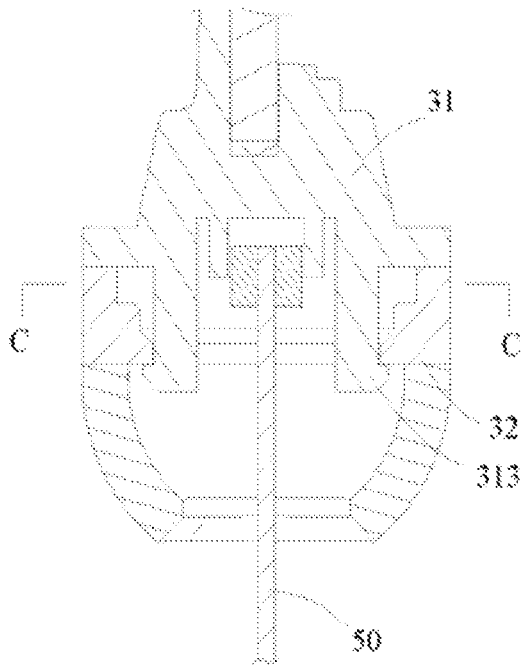
FIG. 12 is a schematic view of the connection between a rotating member and a connecting member in the toothbrush shown in FIG. 11, which is a sectional view.
Figure 13:
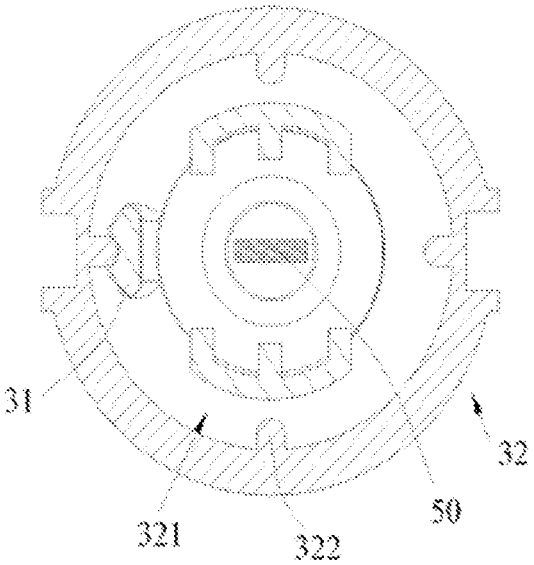
FIG. 13 is a sectional view taken along line C-C of the structure in FIG. 12.

Referring to FIGS. 11 to 13, this embodiment differs from Embodiment I in that specific structures of the first snap-fit member 311 and the first snap-fit member 311 are different. The first snap-fit block is a snap groove that is formed in the rotating member 31 and that is in communication with the insertion groove 321, and the second snap-fit member 322 is a protrusion that is provided on the surface of the connecting member 32 abutting against the insertion groove 321.

In the structure shown in FIG. 13, there are one first snap-fit member 311 and four second snap-fit members 322. The first snap-fit member 311 is snap-fitted with each second snap-fit member 322 in sequence while rotating along with the rotating member 31, to limit the relative rotation of the rotating member 31 and the connecting member 32.

Embodiment IV

Figure 14:
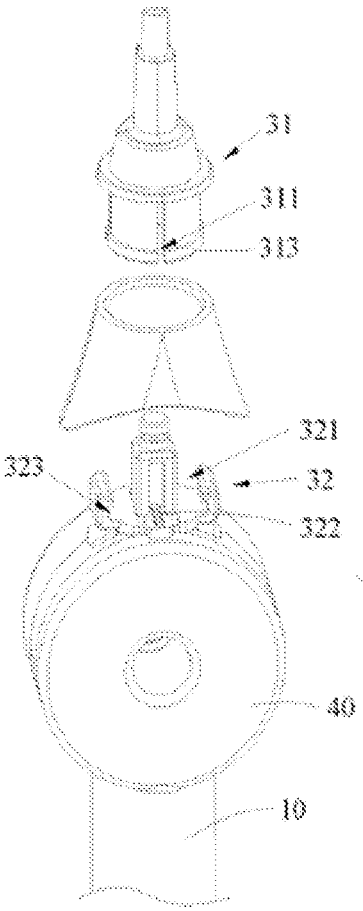
FIG. 14 is a schematic view IV of the toothbrush according to the embodiment of the present application, which is a schematic exploded view of a partial structure.
Figure 15:
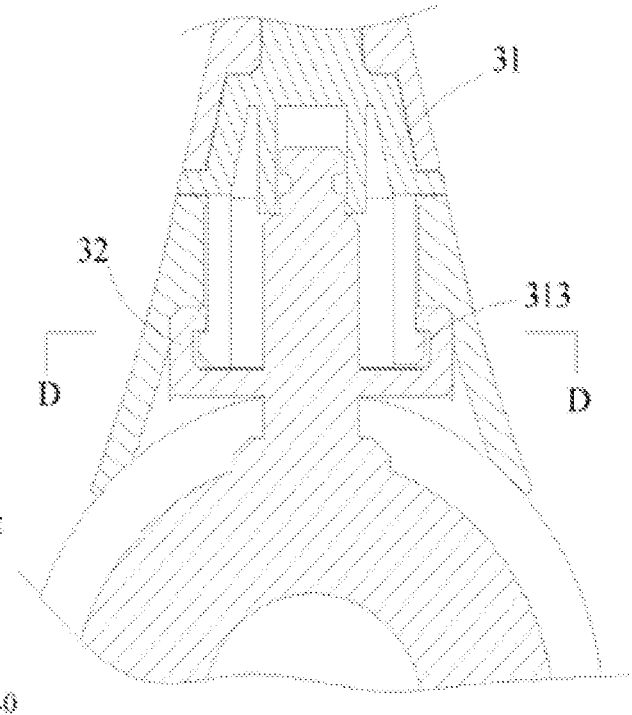
FIG. 15 is a schematic view of the connection between a rotating member and a connecting member in the toothbrush shown in FIG. 14, which is a sectional view.
Figure 16:
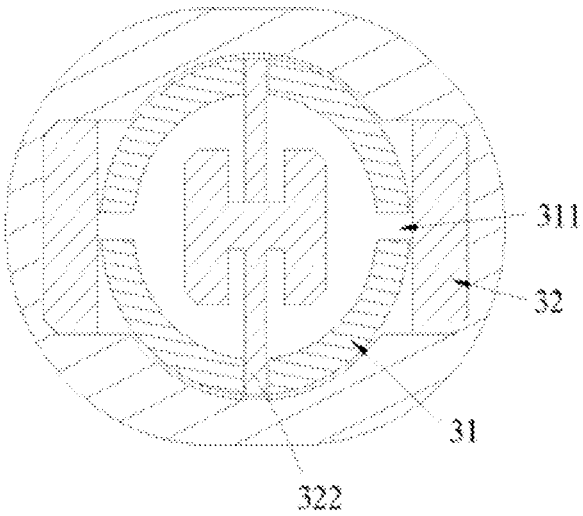
FIG. 16 is a sectional view taken along line D-D of the structure in FIG. 15.

Referring to FIGS. 14 to 16, this embodiment differs from Embodiment I in that specific structures of the first snap-fit member 311 and the first snap-fit member 311 are different. In this embodiment, the first snap-fit block is a snap groove that is formed in the rotating member 31 and that is in communication with the insertion groove 321, and the second snap-fit member 322 is a protrusion that is provided on the surface of the connecting member 32 abutting against the insertion groove 321.

There are four first snap-fit members 311 in a symmetrical fashion in a front and rear direction and in a left and right direction, and there are two second snap-fit members 322 with their connecting line perpendicular to the rotation axis C1. In the structure shown in FIG. 16, the second snap-fit member 322 is strip-shaped, and has a semi-circular cross section to reduce the difficulty of moving relative to the first snap-fit member 311. In other embodiments, the second snap-fit member 322 may also be hemispherical or of another structure, which is not limited herein.

Referring to FIG. 14, the rotating member 31 is provided with four separate extending members that enclose a cylindrical shape. A gap between two adjacent extending members forms a snap groove (first snap-fit member 311). A protrusion (second snap-fit member 322) is provided at a groove bottom of the insertion groove 321 of the connecting member 32, and during the rotation of the rotating member 31 about the rotation axis C1 in the insertion groove 321, any two of the snap grooves being snap-fitted with two protrusions will limit the relative rotation of the rotating member 31 to the connecting member 32. The whole extending member may act as an elastic snap block 313 to be fitted with a first recess 323 formed in the connecting member 32, to limit the axial movements of the rotating member 31 and the connecting member 32.

Embodiment V

This embodiment differs from Embodiments I to IV in that a second rotating structure 40 and an elastic structure 50 are added based on the solutions of Embodiment I, Embodiment II, Embodiment III or Embodiment IV.

Figure 1:
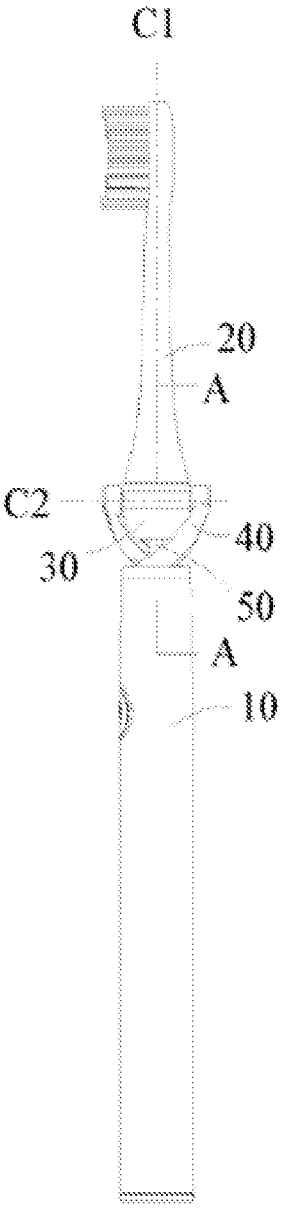
FIG. 1 is a schematic view I of a toothbrush according to an embodiment of the present application.
Figure 5:
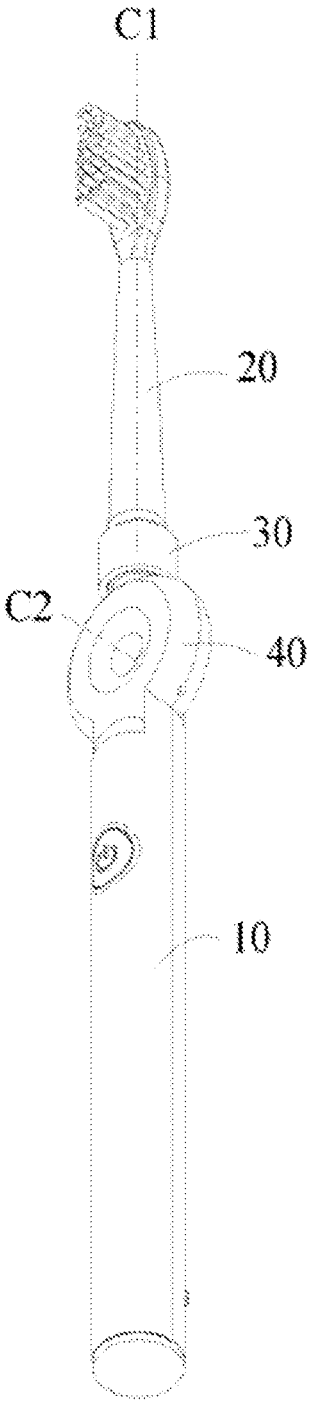
FIG. 5 is a schematic view II of the toothbrush according to the embodiment of the present application.

Referring to FIG. 1 or 5, the connecting member 32 is connected rotatably about a bending axis C2 to the handle 10 via a second rotating structure 40, the bending axis C2 is perpendicular to the rotation axis C1, and the elastic structure 50 is configured to be elastically deformed when the connecting member 32 rotates about the bending axis C2, and to cause the connecting member 32 to be restored after an external force disappears.

An external force is applied to the head 20 to rotate the head 20 about the bending axis C2, and under the external force, the connecting member 32 is bent toward the handle 10. In one embodiment, the elastic structure 50 is elastically deformed (the elastic structure 50 has the capability of changing relative positions of points inside the structure under the action of the external force, and being restored to its original state when the external force is removed). After the external force disappears, the elastic structure 50 causes the connecting member 32 to reversely rotate and be restored while being restored to its original state.

The bending axis C2 extends along a horizontal plane, either in a left and right direction or in a front and rear direction. An extending direction of bristles on the head 20 is defined as a first direction, which is perpendicular to a rotation direction of the head 20. In combination with a design that the head 20 is connected rotatably about the handle 10 on the horizontal plane by means of the first rotating structure 30, the head 20 rotates about the rotation axis C1 to adjust an angle formed by the extending direction of the bristles and the bending axis C2.

The bending of the head 20 relative to the handle 10 is achieved by rotatably connecting the head 20 and the first rotating structure 30 as a whole to the handle 10 via the connecting member 32. The rotational connection of the connecting member 32 and the handle 10 is achieved by means of the second rotating structure 40. The elastic structure 50 is elastically deformed upon the rotation of the head 20 about the bending axis C2, to partially counteract the external force that causes the head 20 to rotate.

According to a specific use scenario of the toothbrush, when the first direction is parallel to the bending axis C2, assuming that the toothbrush carries out brushing from the middle with a fixed pushing force alternately in the direction of the upper teeth and the lower teeth, the head 20 rotates in the opposite directions; when the toothbrush carries out brushing in the direction of the upper teeth, the head 20 rotates in the direction of the lower teeth, correspondingly, when the toothbrush carries out brushing in the direction of the lower teeth, the head 20 rotates in the direction of the upper teeth. The elastic member is elastically deformed to counteract the pushing force, and the actual pressure on the teeth is reduced to protect the teeth. It should be further noted that since there is a linear relationship between the amount of deformation of the elastic member and a frictional force, when the upper teeth and lower teeth are brushed by the toothbrush, the actual pressure on the teeth decreases from the crown to the gum, and the pressure on the gum is the smallest to further protect the gum.

When the rotation axis C1 is perpendicular to the extending direction of the bristles, the bristles face and press against the teeth. In the case of excessive static pressure, the head 20 rotates away from the teeth, and the elastic member is elastically deformed to counteract part of the pressure, and the actual static pressure on the teeth is reduced, to protect the teeth.

In addition, when the toothbrush is used to brush the teeth (regardless of whether brushing up and down between the upper and lower rows of teeth or brushing in an arrangement direction of one row of teeth), the elastic member is elastically deformed and a resistance to the brushing of the toothbrush is reduced, to achieve an effort-saving effect.

As described above, the toothbrush provided in this embodiment can have the effects of protecting the teeth and saving effort by providing the second rotating structure 40 and the elastic structure 50.

In another embodiment of the present utility model, the toothbrush further includes a sensing structure for detecting a pressure on the head 20. The sensing structure senses the pressure on the head 20, and when the sensed pressure is greater than a predetermined threshold, an alarm signal is sent in the form of visible light or sound to remind the user to properly reduce the pressure applied to the toothbrush.

In another embodiment of the present utility model, referring to FIGS. 2 and 4, the second rotating structure 40 includes a connecting shaft 41 connected to the connecting member 32 and extending along the bending axis C2, and a holder 42 connected to the handle 10. The holder 42 is provided with two assembly holes rotatably connected to two ends of the connecting shaft 41 respectively.

The elastic structure 50 is in a shape of a strip extending along the rotation axis C1, the rotating member 31 or the connecting member 32 is provided with a limiting slot 324 for inserting the elastic structure 50, one end of the elastic structure 50 is inserted into the limiting slot 324, the other end is connected to the handle 10 or the holder 42, and the connecting shaft 41 avoids the elastic structure 50. When the limiting slot 324 is formed in the rotating member 31, the connecting member 32 avoids the elastic structure 50.

The elastic structure 50 is elastically bent as the connecting member 32 rotates about the bending axis C2.

The rotational connection between the connecting member 32 and the handle 10 is achieved by means of the fitting of the connecting shaft 41 and the assembly holes in the holder 42. In the illustrated structure, the connecting shaft 41 includes a first shaft section and a second shaft section that are provided on two opposite sides of the connecting member 32. The first shaft section and the second shaft sections are provided coaxially and are spaced apart to avoid the elastic structure 50.

The elastic structure 50 is in a strip shape, with one end fixed, and the other end elastically bent when being subjected to a radial acting force and restored after the external force disappears. It should be noted that the strip shape refers to a structural member having an elongated feature, and the elastic structure 50 in the strip shape may extend in a length direction in the form of a straight line, or forwardly extend in a wavy or spiral manner.

In the structure shown in FIG. 5, one end of the elastic structure 50 is inserted and fixed to the handle 10, and the other end is inserted into the limiting slot 324. The elastic structure 50 is in clearance fit with the limiting slot 324, and an upper end of the elastic structure 50 and the limiting slot 324 can move relative to each other, so that when being bent, the elastic structure 50 is only subjected to a radial pressure, rather than an axial tension. This configuration facilitates the prolonging of the service life of the elastic structure 50.

In this embodiment, the elastic structure 50 is a metal strip. In other embodiments, the elastic structure 50 may also be made of an elastic plastic or other materials, which is not limited herein.

In another embodiment of the present utility model, the holder 42 is provided with a limiting block on a hole wall of the assembly hole, and the connecting shaft 41 is provided with a movement groove for receiving the limiting block and limiting a rotation angle of the limiting block. Rotation angles of the head 20 and the handle 10 about the bending axis C2 are limited by providing the movement groove and the limiting block, and the structure is simple and ingenious.

Embodiment VI

This embodiment differs from Embodiment V in a different second rotating structure 40 and elastic structure 50.

Figure 8:
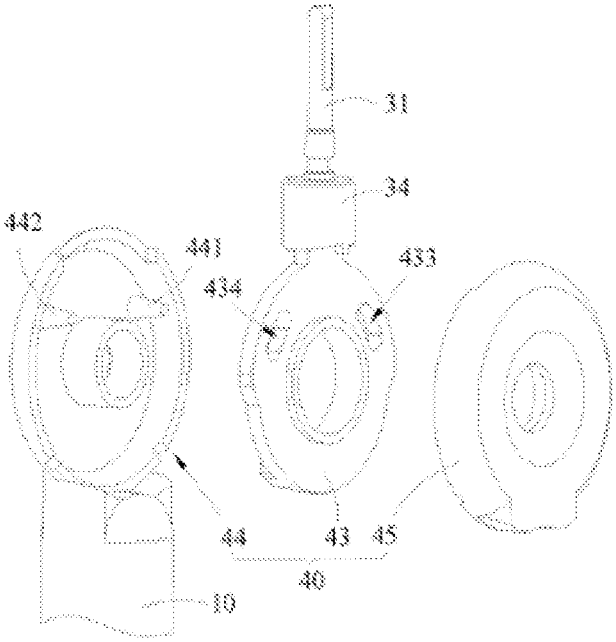
FIG. 8 is a partial schematic exploded view II of the structure in FIG. 5.
Figure 9:
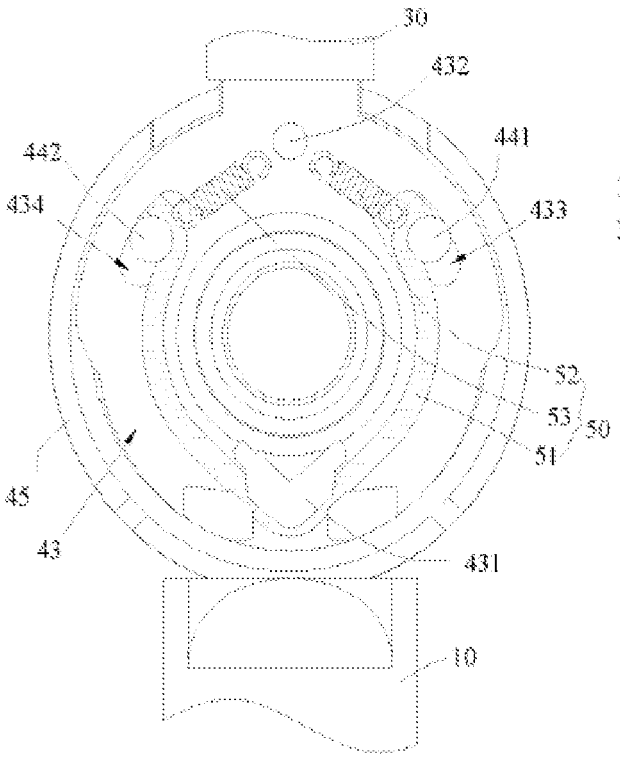
FIG. 9 is a schematic view of the connection between an elastic structure and a second rotating structure of the toothbrush shown in FIG. 5, with a first elastic member shown filled.

Referring to FIGS. 7 to 9, the second rotating structure 40 includes a first rotating disk 43 connected to the connecting member 32 and a second rotating disk 44 connected to the handle 10. The first rotating disk 43 and the second rotating disk 44 are coaxially arranged and can rotate relative to each other along the bending axis C2.

The elastic structure 50 includes a first elastic member 51 formed by connecting a first arm 511 and a second arm 512. Ends of the first arm 511 and the second arm 512 that are connected to each other are fixed-ends connected to the first rotating disk 43, free ends of the first arm 511 and the second arm 512 both abut against or are connected to the second rotating disk 44, and when the first rotating disk 43 and the second rotating disk 44 rotate, the elastic structure 50 is elastically deformed.

In this embodiment, the rotational connection between the connecting member 32 and the handle 10 is achieved by means of the relative rotation of the first rotating disk 43 and the second rotating disk 44, and the restoring of the head 20 and the handle 10 after bending is achieved by means of the fitting of the first elastic member 51 with the first rotating disk 43 and the second rotating disk 44. This configuration, in combination with the foregoing analysis on the use of the toothbrush, similarly has the effect of protecting the teeth.

Figure 10:
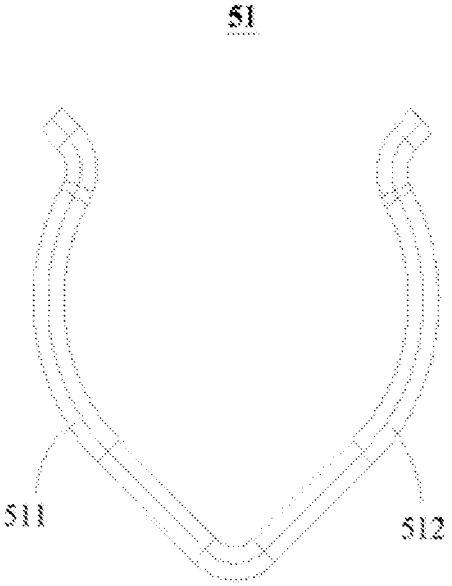
FIG. 10 is a schematic structural view of the first elastic member in the toothbrush shown in FIG. 5.

Referring to FIGS. 9 and 10, the first elastic member 51 is formed by connecting a first arm 511 and a second arm 512 that are strip-shaped. When one end of the first arm 511/the second arm 512 is fixed and the other end is subjected to a radial acting force, the first arm 511/the second arm 512 is elastically deformed. The whole first elastic member 51 is V-shaped, mutually connected ends of the first arm 511 and the second arm 512 are connected, and free ends of the first arm 511 and the second arm 512 abut against the second rotating disk 44. When the first rotating disk 43 and the second rotating disk 44 rotate, the first arm 511 or the second arm 512 is elastically deformed, and causes the first rotating disk 43 to rotate for restoring after the external force disappears.

In other embodiments, the free ends of the first arm 511 and the second arm 512 may also be fixedly or movably connected to the second rotating disk 44. In this case, when the first rotating disk 43 and the second rotating disk 44 relatively rotate, the first arm 511 and the second arm 512 are elastically deformed simultaneously, and jointly cause the first rotating disk 43 to rotate for restoring after the external force disappears.

In the structure shown in FIG. 10, the first arm 511 and the second arm 512 are symmetrically arranged, and have the same degree of elastic deformation when the same external force causes the first rotating disk 43 and the second rotating disk 44 to rotate forwardly and reversely; in combination with the use of the toothbrush, when the bending axis C2 is parallel to the extending direction of the bristles, during the alternate brushing of the upper teeth and the lower teeth by the toothbrush, the upper and lower rows of teeth have substantially the same stress and cleaning effect under the same brushing force, to improve the comfort of brushing.

In one embodiment, the first arm 511 and the second arm 512 are strip-shaped, and have curved extending paths. This improves the structural strength and bending resistance and further enhances the capability of dissipating a pressure applied by the elastic structure 50 during brushing, to reduce the actual pressure on the teeth and protecting the teeth.

In another embodiment of the present utility model, referring to FIGS. 8 and 9, a snap block 431 is provided on the surface of the first rotating disk 43 facing the second rotating disk 44, and the snap block 431 is provided with a second snap-fit member 322 snap-fitted with the fixed-end.

A first protruding post 441 and a second protruding post 442 are provided on the surface of the second rotating disk 44 facing the first rotating disk 43, and the first protruding post 441 and the second protruding post 442 respectively abut against the free ends of the first arm 511 and the second arm 512.

The first rotating disk 43 is provided with a first kidney-shaped slot 433 that is used for inserting the first protruding post 441 and limiting a rotation angle of the first protruding post 441, and a second kidney-shaped slot 434 that is used for inserting the second protruding post 442 and limiting a rotation angle of the second protruding post 442.

The whole first elastic member 51 is V-shaped, and is snap-fitted with the snap block 431 at a corner to enable a fixed connection between the first elastic member 51 and the first rotating disk 43, facilitating the simplification of the structure and assembly.

The two free ends of the first elastic member 51 abut against the second rotating disk 44 by abutting against the first protruding post 441 and the second protruding post 442, facilitating the simplification of the structure.

The configuration of the first kidney-shaped slot 433 and the second kidney-shaped slot 434 limits the rotation angles of the first protruding post 441 and the second protruding post 442, to limit the rotation angles of the head 20 and the handle 10 about the bending axis C2, simplifying the structure.

In another embodiment of the present utility model, referring to FIG. 9, a third protruding post 432 is provided on the surface of the first rotating disk 43 facing the second rotating disk 44.

The elastic structure 50 further includes a second elastic member 52 and a third elastic member 53. The second elastic member 52 and the third elastic member 53 are both tension springs. The second elastic member 52 has one end connected to the first protruding post 441 and the other end connected to the third protruding post 432, and the third elastic member 53 has one end connected to the second protruding post 442 and the other end connected to the third protruding post 432.

By providing the second elastic member 52 and the third elastic member 53, the bending resistance of the first elastic member 51 is enhanced, the capability of dissipating the pressure applied by the elastic structure 50 during brushing is improved, the actual pressure on the teeth is further reduced, and the teeth are thus protected.

In another embodiment of the present utility model, referring to FIG. 7, a rotating cylinder is provided on the surface of the second rotating disk 44 facing the first rotating disk 43, and the first rotating disk 43 is fitted over the rotating cylinder and rotates around the rotating cylinder.

The rotating structure further includes a fastener 45. The fastener 45 is in a fastening connection with the second rotating disk 44 to sandwich the first rotating disk 43 therein, and the fastener 45 and/or the second rotating disk 44 is provided with an avoidance hole for avoiding the connection between the first rotating disk 43 and the head 20.

The second rotating disk 44 and the fastener 45 are in a fastening connection to form an accommodating cavity for accommodating the first rotating disk 43. The first rotating disk 43 is placed inside the accommodating cavity and provided at an outside of the rotating cylinder. The central axis of the rotating cylinder is the bending axis C2. The connecting member 32 passes through the avoidance hole and is connected to the first rotating disk 43. One or all of the avoidance hole, the first kidney-shaped slot 433 and the second kidney-shaped slot 434 limit the maximum rotation angles of the head 20 and the handle 10 about the bending axis C2.

The above descriptions are embodiments of the present disclosure and are not used to limit the present disclosure. Any modifications, equivalent replacements or improvements, etc. that are made within the spirit and principle of the present disclosure should be included within the scope of protection of the present disclosure.

What is claimed is:

1. A toothbrush, comprising:

a head, a handle, and a first rotating structure, wherein the head has a rotation axis extending in a length direction;

the first rotating structure comprises a rotating member connected to the head and a connecting member connected to the handle, a surface of the connecting member facing the head is provided with an insertion groove extending along the rotation axis, and an end of the rotating member facing away from the head is inserted into the insertion groove and is rotatably connected to the connecting member;

the rotating member is provided with a first snap-fit member, and the connecting member is provided with a plurality of second snap-fit members, the first snap-fit member is capable of passing over each second snap-fit member in sequence while rotating along with the rotating member, and is snap-fitted with any one of the second snap-fit members to limit the rotation of the rotating member when opposite the second snap-fit member; or the rotating member is provided with a plurality of first snap-fit members, and the connecting member is provided with a second snap fit member, the first snap-fit members are capable of passing over the second snap-fit member in sequence while rotating along with the rotating member, and any one of the first snap-fit members is snap-fitted with the second snap-fit member to limit the rotation of the rotating member when opposite the second snap-fit member, said toothbrush further comprising a second rotating structure and an elastic structure, wherein the connecting member is connected rotatably about a bending axis to the handle via the second rotating structure, the bending axis is perpendicular to the rotation axis, and the elastic structure is configured to be elastically deformed when the connecting member rotates about the bending axis;

wherein the second rotating structure comprises a first rotating disk connected to the connecting member and a second rotating disk connected to the handle, and the first rotating disk and the second rotating disk are coaxially arranged and are rotatable relative to each other along the bending axis; the elastic structure comprises a first elastic member formed by connecting a first arm to a second arm, ends of the first arm and the second arm that are connected to each other are fixed-ends connected to the first rotating disk, free ends of the first arm and the second arm both abut against or are connected to the second rotating disk, and when the first rotating disk and the second rotating disk rotate, the elastic structure is elastically deformed.

2. The toothbrush of claim 1, wherein there are four second snap-fit members, which are arranged about the rotation axis at equal intervals.

3. The toothbrush of claim 1, wherein an outer surface of the rotating member is provided with an annular second-groove, and an outer surface of the connecting member is provided with an insertion hole in communication with the insertion groove; and the first rotating structure comprises a connecting pin arranged in the insertion hole and extending into the annular groove.

4. The toothbrush of claim 3, wherein the first rotating structure further comprises a protective sleeve provided at an outside of the connecting member, and the protective sleeve restricts the connecting pin from leaving the insertion hole.

5. The toothbrush of claim 1, wherein the toothbrush further comprises a sensing structure for detecting a pressure on the head.

6. The toothbrush of claim 1, wherein the elastic structure is a metal strip.

7. The toothbrush of claim 1, wherein the first arm and the second arm are strip-shaped, and have curved extending paths.

8. The toothbrush of claim 1, wherein the first arm and the second arm are symmetrically arranged.

9. The toothbrush of claim 1, wherein the elastic structure further comprises a second elastic member and a third elastic member, the second elastic member and the third elastic member are both tension springs, two ends of the second elastic member are connected to the first rotating disk and the second rotating disk respectively, and two ends of the third elastic member are connected to the first rotating disk and the second rotating disk respectively.

* * * * *